US011523700B2

(12) United States Patent
Tan et al.

(10) Patent No.: US 11,523,700 B2
(45) Date of Patent: Dec. 13, 2022

(54) TELESCOPIC HANGING ROD FOR CURTAIN FABRIC

(71) Applicant: NINGBO LIYANG NEW MATERIAL COMPANY LIMITED, Ningbo (CN)

(72) Inventors: Baoguo Tan, Ningbo (CN); Chun Jiang, Ningbo (CN)

( * ) Notice: Subject to any disclaimer, the term of this patent is extended or adjusted under 35 U.S.C. 154(b) by 0 days.

(21) Appl. No.: 17/151,438

(22) Filed: Jan. 18, 2021

(65) Prior Publication Data

US 2021/0219762 A1 Jul. 22, 2021

(30) Foreign Application Priority Data

Jan. 20, 2020 (CN) ..... 202010065888.2

(51) Int. Cl.
*A47H 1/022* (2006.01)
*A47K 3/38* (2006.01)

(52) U.S. Cl.
CPC ..... *A47H 1/022* (2013.01); *A47K 3/38* (2013.01)

(58) Field of Classification Search
CPC .. A47H 1/022; A47H 2001/0215; A47K 3/38; E06B 9/44; E06B 2009/407
See application file for complete search history.

(56) References Cited

U.S. PATENT DOCUMENTS 565,546 A * 8/1896 Kingston ..... A47H 1/022 211/105.4
1,233,884 A * 7/1917 Kraemer et al. ..... E06B 9/44 160/133
1,370,862 A * 3/1921 Vasger ..... A47H 1/022 211/105.6
1,456,214 A * 5/1923 Boye ..... A47H 1/022 211/105.3
1,951,660 A * 3/1934 Klaudt ..... A47H 1/022 248/354.3
2,385,608 A * 9/1945 Castagna ..... A47H 1/022 211/105.3
2,661,850 A * 12/1953 Fowler ..... A47H 1/022 211/105.4
2,848,769 A * 8/1958 Oakley ..... E04C 3/36 403/345

(Continued)

FOREIGN PATENT DOCUMENTS

GB 2544545 A * 5/2017 ..... E06B 9/40

*Primary Examiner* — Stanton L Krycinski

(57) ABSTRACT

A telescopic hanging rod for a curtain fabric is disclosed, which comprises a hanging rod body and a telescopic mechanism arranged on at least one end of the hanging rod body; the telescopic mechanism comprises a first telescopic connecting portion connected to the hanging rod body, and a second telescopic connecting portion slidably connected with the first telescopic connecting portion; the first telescopic connecting portion and the second telescopic connecting portion are coaxially arranged. The length of the hanging rod can be adjusted to a certain degree in accordance with the size of the mounting space during the mounting process, thereby lowering difficulty in dimension measurement prior to installation. Besides, the width of a curtain fabric is also adjustable, hence, standard batched production is achieved, while the production scale is enlarged, and the production cost reduced.

17 Claims, 10 Drawing Sheets

(56) References Cited

U.S. PATENT DOCUMENTS 3,000,656 A * 9/1961 Hollaender ..... F16B 7/0413 403/292
3,340,922 A * 9/1967 Anderson ..... E06B 9/44 160/326
3,521,694 A * 7/1970 Anderson ..... E06B 9/44 160/323.1
3,932,048 A * 1/1976 DuPont ..... F16B 12/40 403/295
4,636,106 A * 1/1987 Waisbrod ..... F16B 7/10 403/228
4,809,401 A * 3/1989 Honig ..... A47H 1/102 248/265
6,430,891 B1 * 8/2002 Adams ..... E04B 1/58 403/359.1
7,186,050 B2 * 3/2007 Dean ..... F16B 12/40 403/379.6
7,325,696 B2 * 2/2008 Matthew ..... B60R 7/10 211/206
7,658,219 B2 * 2/2010 Whittemore ..... E04G 21/24 248/200.1
7,857,151 B2 * 12/2010 Barrese ..... A47K 3/38 211/105.3
8,056,873 B1 * 11/2011 Hanley ..... A47H 1/142 248/261
8,215,501 B2 * 7/2012 Trettin ..... A47K 3/38 211/105.6
8,408,486 B2 * 4/2013 Di Stefano ..... E06B 9/50 160/326
8,651,166 B1 * 2/2014 Daniels ..... E06B 9/44 160/250
8,672,115 B1 * 3/2014 Jennings ..... F16D 49/02 192/223.4
8,827,587 B2 * 9/2014 Didehvar ..... A47H 1/022 248/265
8,899,300 B2 * 12/2014 Daniels ..... E06B 9/44 160/250
10,072,425 B1 * 9/2018 Madden ..... E04F 11/1836
10,436,235 B2 * 10/2019 Daniels ..... B25G 1/04
10,458,452 B2 * 10/2019 Beyda ..... A47K 3/38
10,472,886 B2 * 11/2019 Nelson ..... E06B 9/72
10,597,938 B2 * 3/2020 Tan ..... E06B 9/42
10,844,890 B2 * 11/2020 Daniels ..... F16B 7/1445
2012/0103924 A1 * 5/2012 Chuang ..... A47H 1/022 211/123
2012/0284914 A1 * 11/2012 Bauer ..... A47K 3/38 4/610
2013/0092646 A1 * 4/2013 Wang ..... A47H 1/142 211/123
2019/0345762 A1 * 11/2019 Cheng ..... E06B 9/50

* cited by examiner

TELESCOPIC HANGING ROD FOR CURTAIN FABRIC

CROSS-REFERENCE TO RELATED APPLICATIONS

This application claims priority to Chinese Patent Application No. 202010065888.2 with a filing date of Jan. 20, 2020. The content of the aforementioned applications, including any intervening amendments thereto, are incorporated herein by reference.

TECHNICAL FIELD

The present invention relates to a mounting device for a curtain fabric, in particular to a hanging rod for a curtain fabric to be installed.

BACKGROUND

The existing hanging curtain usually comprises a curtain fabric and a hanging rod, and the hanging curtain such as a window curtain, a door curtain, a shower curtain and the like mainly adopts a customized production. To be specific, the dimensions of the location where a hanging curtain is planned to be installed are measured, and then the hanging curtain is produced in a customized manner according to the specific measured dimensions including the length of a customized rod, the width of a curtain fabric and so on. In this process, it is easy to cause inaccurate measured dimensions due to various reasons, particularly, the length of the hanging rod does not match with the width of the to-be-installed location so that the hanging curtain cannot be successfully installed, or the hanging curtain is scrapped because of overlarge gaps, causing a great waste of social resources.

SUMMARY

To resolve the foregoing problems, it is an object of the present invention to provide a curtain fabric rod of which the length can be adjusted in accordance with the width of a to-be-installed location.

The technical solution of the present invention provides a telescopic hanging rod for a curtain fabric, comprising a hanging rod body and a telescopic mechanism arranged on at least one end of the hanging rod body. The telescopic mechanism comprises a first telescopic connecting portion connected to the hanging rod body, and a second telescopic connecting portion slidably connected with the first telescopic connecting portion. The first telescopic connecting portion and the second telescopic connecting portion are coaxially arranged.

With the aforementioned structure, the length of the hanging rod is adjustable through the sliding of the first telescopic connecting portion and the second telescopic connecting portion that are in slidable connection, therefore, the length of the hanging rod can be adjusted to a certain degree in accordance with the size of the mounting space during the mounting process, thereby lowering difficulty in dimension measurement prior to installation. As the dimensions of the to-be-installed location gradually become standard, the width of a curtain fabric is also adjustable, hence, standard batched production is realized, and production cost and sales price are greatly reduced. In a word, the telescopic hanging rod for a curtain fabric is simple in structure, energy-saving and environmentally-friendly.

Further, the first telescopic connecting portion and the second telescopic connecting portion have the same outer diameter.

In one embodiment, one end of the second telescopic connecting portion away from the hanging rod body is provided with a connecting part for connection with other installation parts.

In one embodiment, the telescopic hanging rod for a curtain fabric further comprises a locking mechanism for locking the telescopic mechanism in a telescopic state; the locking mechanism, the first telescopic connecting portion and the second telescopic connecting portion are coaxially arranged; the locking mechanism penetrates into both the first telescopic connecting portion and the second telescopic connecting portion, and is rotatable around the axis and linearly movable in the axial direction.

In one embodiment, the locking mechanism comprises a columnar body; the external surface of the columnar body is provided with a locking slot; the internal surface of the first telescopic connecting portion is provided with a first locking block matched with the locking slot, and the internal surface of the second telescopic connecting portion is provided with a second locking block matched with the locking slot.

In one embodiment, a plurality of locking slots are provided and they form a locking slot row extending axially, and at least one locking slot row is arranged.

Preferably, at least two locking slot rows are arranged, and these at least two locking slot rows are evenly distributed along the circumferential direction of the columnar body of the locking mechanism.

In one embodiment, in accordance with the rotating direction of the columnar body in the locking process, the side of the locking slot first approaching to the locking block is an open side, and the side of the locking slot secondarily approaching to the locking block is a closed side.

In one embodiment, the first locking block is arranged on the internal surface of the first telescopic connecting portion away from the hanging rod body, and the second locking block is arranged on the internal surface of the second telescopic connecting portion away from the hanging rod body.

In a preferred embodiment, one end of the locking mechanism, the end of which away from the hanging rod body, is connected with an end cover, and the end cover rotates to drive the locking mechanism to rotate.

In a preferred embodiment, the lateral surface of the end cover is a coarse surface.

In a preferred embodiment, a connecting part is arranged on the end surface of the end cover away from the hanging rod body.

In a further preferred embodiment, one end of the connecting part penetrates through the end cover and inserts into the locking mechanism to be fixed.

In a further preferred embodiment, the external surface of the first telescopic connecting portion is provided with at least two sliding parts along the circumferential direction; the sliding parts are strip-like sliding parts of which the lengths extend in the axial direction; the external surface of the second telescopic connecting portion is provided with sliding grooves matched with the sliding parts.

In a further preferred embodiment, the sliding part comprises a first sliding part and a second sliding part; the first sliding part and the second sliding part are distributed at intervals; the second sliding part is directly connected with the external lateral surface of the first telescopic connecting portion; one end, close to the hanging rod body, of the first sliding part is connected with the first telescopic connecting portion, and is suspended from the external lateral surface of the first telescopic connecting portion.

Accordingly, the sliding groove comprise a first sliding groove and a second sliding groove; the first sliding groove and the second sliding groove are distributed at intervals; the cross section of the first sliding groove is a "C" shape; a gap between every two adjacent first sliding grooves form the second sliding groove; the first sliding groove is matched with the first sliding part and the second sliding groove is matched with the second sliding part.

In a further preferred embodiment, the two sides of the "C" shape cross section of the first sliding groove are with curled edges, different from a concave shape with two straight edges. The distance between the tail ends of the two curled edges is slightly greater than the width of the widest portion of the first sliding part.

In a further preferred embodiment, the section of the sliding part is of an isosceles trapezoid shape; the short side of the isosceles trapezoid is close to the external lateral surface of the first telescopic connecting portion, and the long side is far away from the external lateral surface of the first telescopic connecting portion.

EMBODIMENTS

The present invention will be further explained by referring to the particular embodiments below.

In the description of the invention, it should be understood that, all directional or positional relationships indicated by the terms including "center", "longitudinal direction", "transverse direction", "length", "width", "thickness", "upper", "lower", "front", "back", "left", "right", "vertical", "horizontal", "top", "bottom", "inside", "outside", "clockwise", "anticlockwise", "axial direction", "radial direction", "circumferential direction" and the like are merely for the purpose of conveniently and simply describing the present invention, instead of indicating or hinting the device or component referred to must have the particular orientation or be structured and operated at the particular orientation, and thus cannot be read to limitations to the present invention.

Besides, the terms "first" and "second" are merely for descriptive purpose, and thus cannot be understood as indicating or hinting relative importance or implying the quantity of the mentioned technical features. Therefore, the features defined by the terms "first" and "second" may explicitly or implicitly comprise at least one such feature. In the description of the present invention, the wording "a plurality of" means at least two, e.g., two, three or the like unless otherwise clearly defined.

In the present invention, unless otherwise clearly stipulated, the terms "mount", "link", "connect", "fix" and the like should be understood in a broad sense, e.g., fixed connection, detachable connection or integral connection; or mechanical connection, or electrical connection; or direct connection, or indirect connection via a medium. It may further refer to interior communication or interaction of two components unless otherwise explicitly defined. For those of ordinary skill in the art, its particular meanings can be understood depending on the particular contexts.

In the present invention, unless otherwise clearly stipulated, the expression that a first feature is "above" or "below" a second feature may mean that the first and second features are in direct contact, or in indirect contact via a medium. Moreover, the expression that the first feature is "over", "above" or on the "top" of the second feature may mean that the first feature is over or above the second feature, or the first feature is merely higher than the second feature in the horizontal height. The expression that the first feature is "under", "below" or on the "bottom" of the second feature may mean that the first feature is under or below the second feature, or the first feature is merely shorter than the second feature in the horizontal height.

Figure 2A:
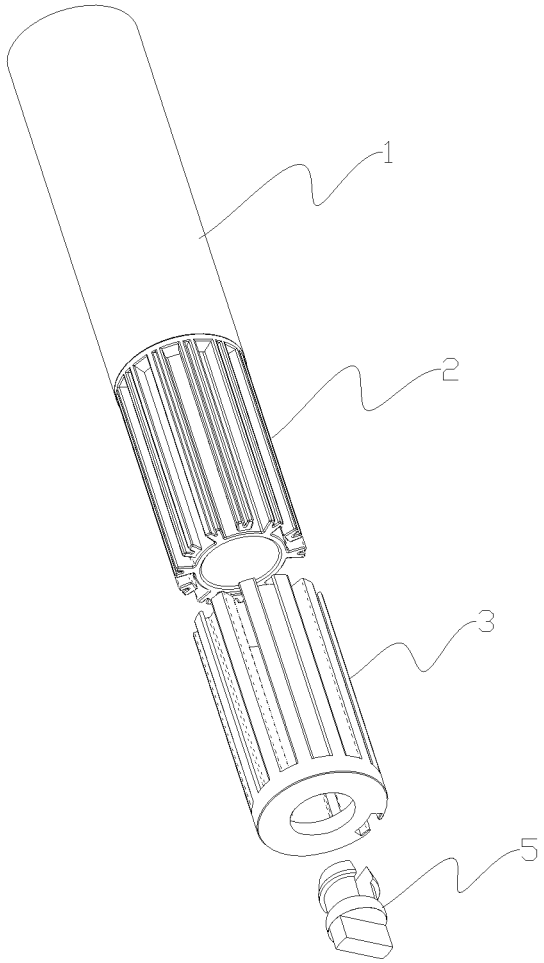
FIG. 2*a* is a schematic diagram of an assembly structure of the telescopic hanging rod for a curtain fabric of the present invention.
Figure 2B:
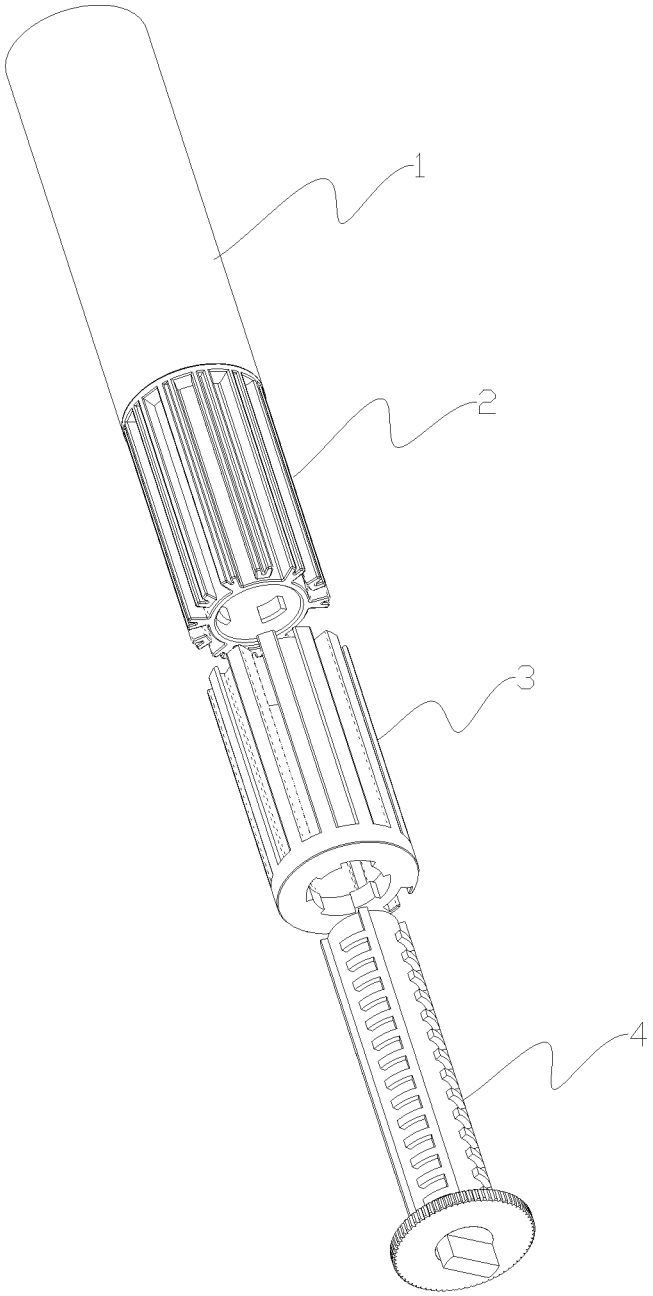
FIG. 2*b* is a schematic diagram of another assembly structure of the telescopic hanging rod for a curtain fabric of the present invention.
Figure 3:
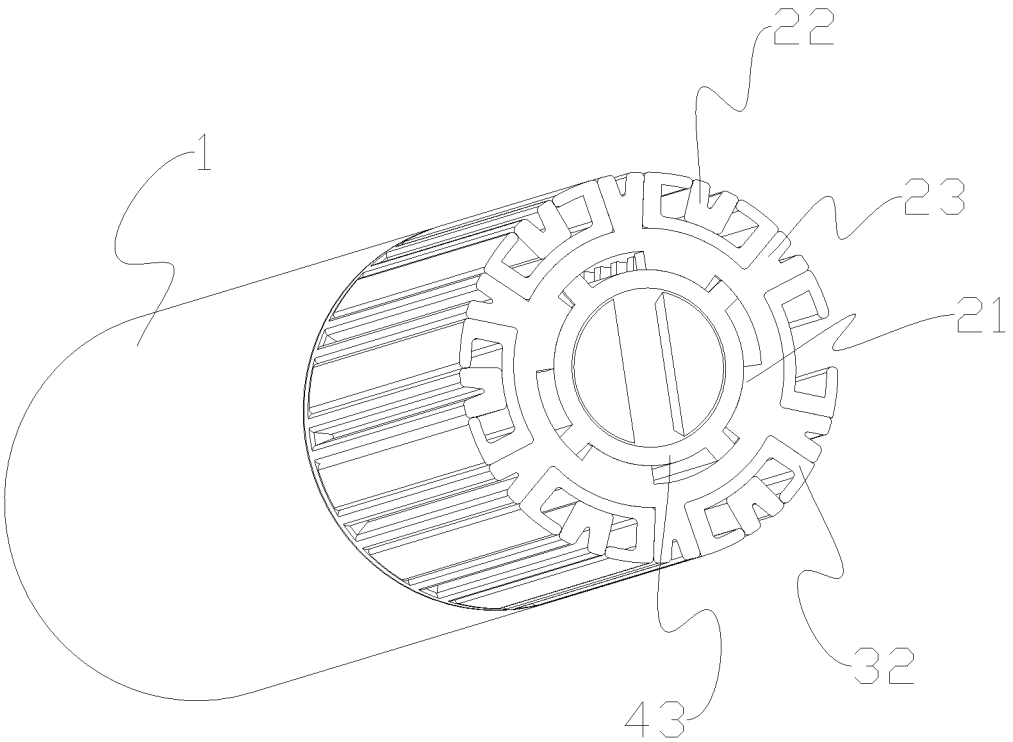
FIG. 3 is a schematic diagram of an interior structure of the telescopic hanging rod for a curtain fabric of the present invention.
Figure 4:
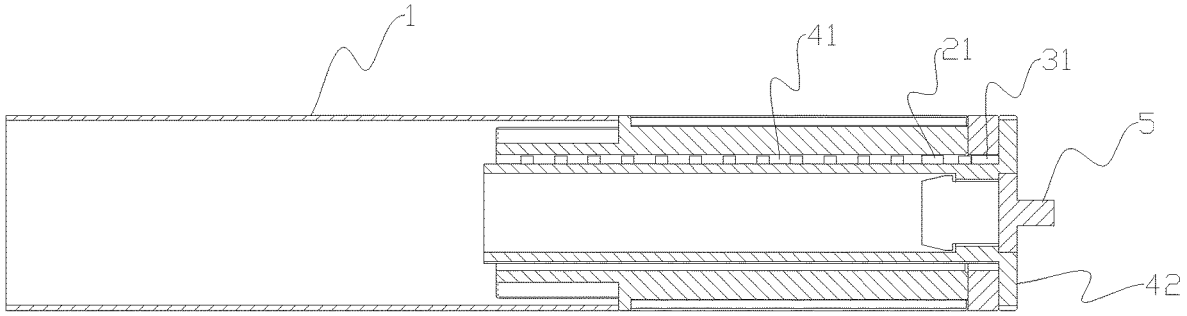
FIG. 4 is a schematic diagram of an interior structure of the telescopic hanging rod for a curtain fabric of the present invention, viewed from another angle.
Figure 5:
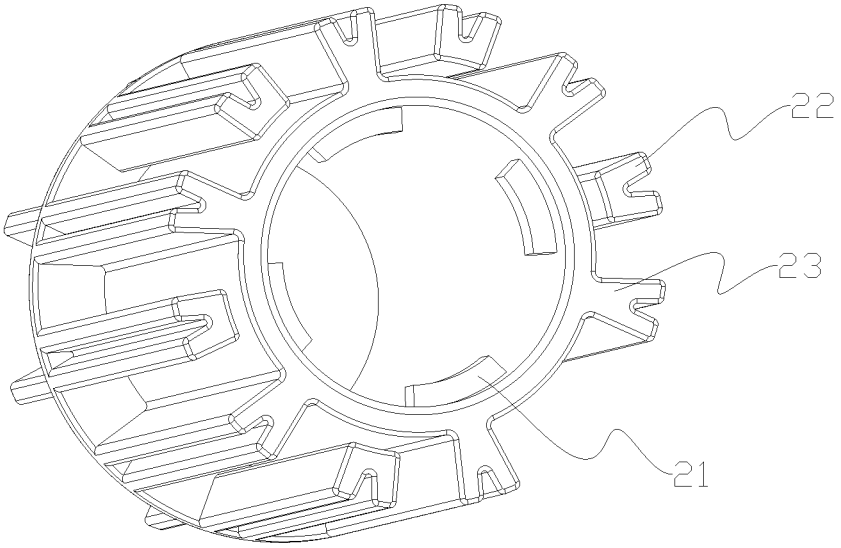
FIG. 5 is a schematically structural diagram of a first telescopic connecting portion of FIG. 2*a* or FIG. 2*b*.
Figure 6:
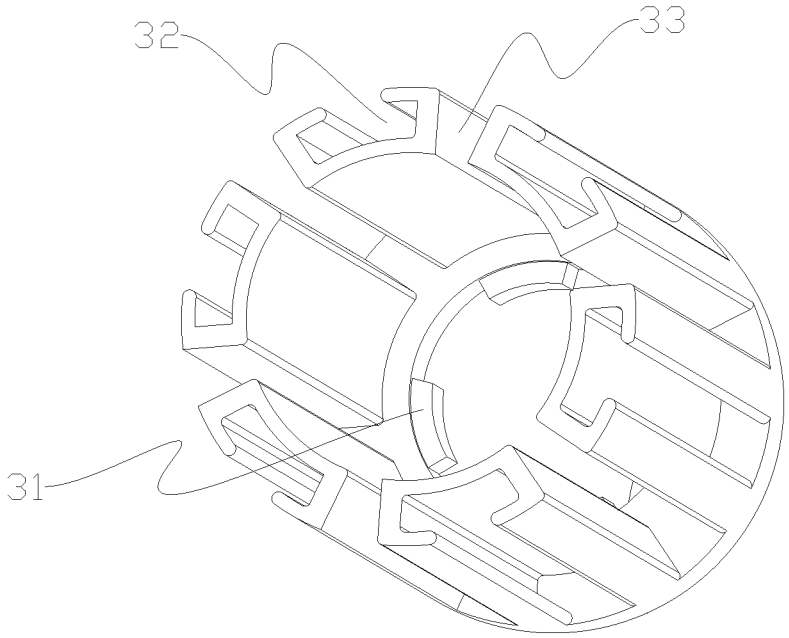
FIG. 6 is a schematically structural diagram of a second telescopic connecting portion of FIG. 2*a* or FIG. 2*b*.
Figure 7:
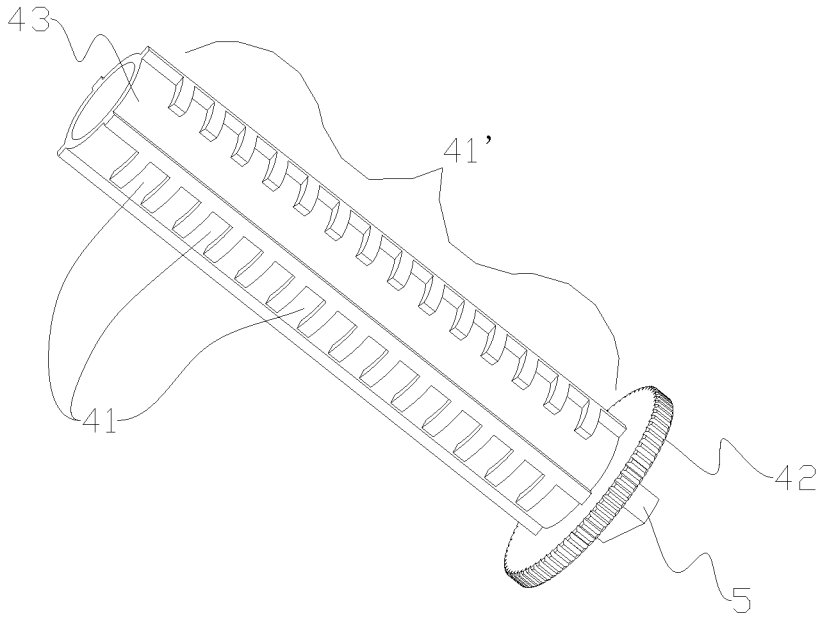
FIG. 7 is a schematically structural diagram of a locking mechanism of FIG. 2*b*.
Figure 8:
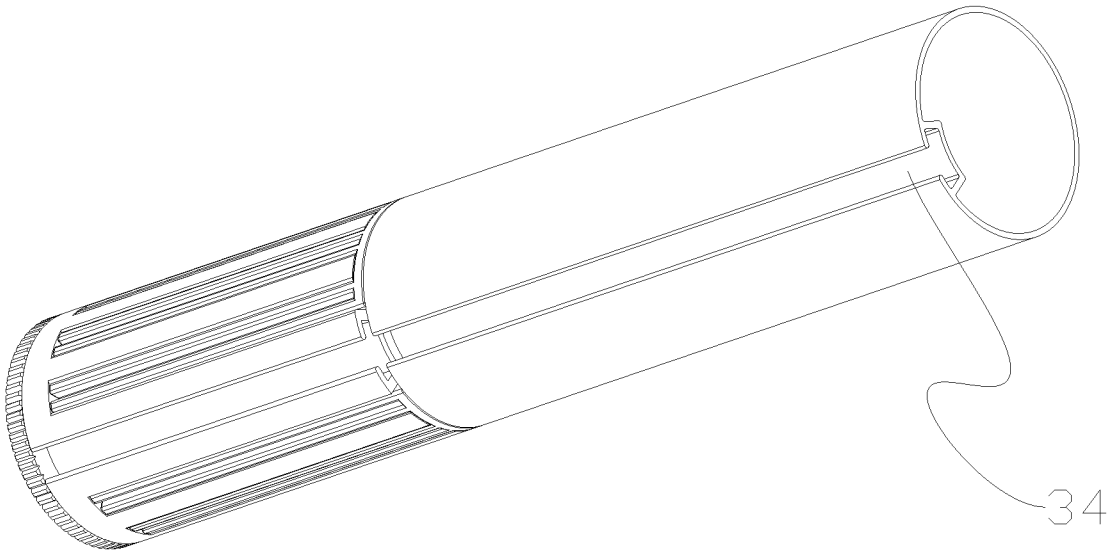
FIG. 8 is a schematic diagram of a curtain fabric mounting groove of the telescopic hanging rod for a curtain fabric of the present invention.
Figure 9:
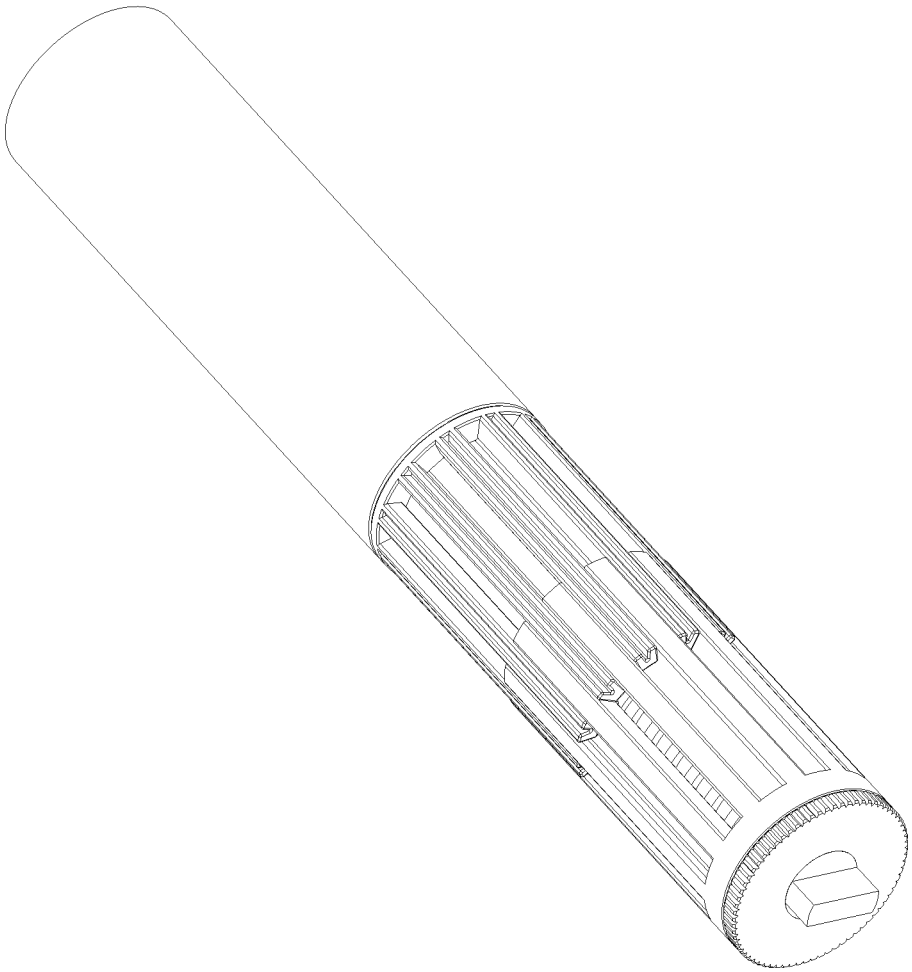
FIG. 9 is a schematic diagram of the telescopic hanging rod for a curtain fabric of the present invention in an extended state.

The present invention provides a telescopic hanging rod for a curtain fabric. As shown in FIGS. 1-9, FIG. 1 is a schematic diagram of the telescopic hanging rod for a curtain fabric in a contracted state; FIG. 2*a* is a schematic diagram of an assembly structure of the telescopic hanging rod for a curtain fabric; FIG. 2*b* is a schematic diagram of another assembly structure of the telescopic hanging rod for a curtain fabric; FIG. 3 is a schematic diagram of an interior structure of the telescopic hanging rod for a curtain fabric; FIG. 4 is a schematic diagram of an interior structure of the telescopic hanging rod for a curtain fabric, viewed from another angle; FIG. 5 is a schematically structural diagram of a first telescopic connecting portion 2 of FIG. 2*a* or FIG. 2*b*; FIG. 6 is a schematically structural diagram of a second telescopic connecting portion 3 of FIG. 2*a* or FIG. 2*b*; FIG. 7 is a schematically structural diagram of a locking mechanism 4 of FIG. 2*b*; FIG. 8 is a schematic diagram of a curtain fabric mounting groove of the telescopic hanging rod for a curtain fabric of the present invention; and FIG. 9 is a schematic diagram of the telescopic hanging rod for a curtain fabric of the present invention in an extended state.

As shown in FIG. 2*a*, the telescopic hanging rod for a curtain fabric of the present invention comprises a hanging rod body 1 (merely a portion of the hanging rod body 1 is shown in this figure) and a telescopic mechanism arranged on at least one end of the hanging rod body 1. The telescopic mechanism comprises the first telescopic connecting portion 2 connected to the hanging rod body 1, and the second telescopic connecting portion 3 slidably connected with the first telescopic connecting portion 2. The first telescopic connecting portion 2 and the second telescopic connecting portion 3 are coaxially disposed.

In specific use, by arranging a telescopic mechanism on at least one end of the hanging rod body, the length of the hanging rod is adjustable through sliding of the first telescopic connecting portion 2 and the second telescopic connecting portion 3 that are in slidable connection. Therefore, on the premise of slidable connection, when the first telescopic connecting portion 2 and the second telescopic connecting portion 3 move away from each other, the entire rod is extended, but when the first telescopic connecting portion 2 and the second telescopic connecting portion 3 move toward each other, the entire rod is shortened. In this case, the length of the hanging rod can be adjusted to a certain degree in accordance with the size of the mounting space during the mounting process, requirements on dimension precision in measurement are lowered, and construction and installation are convenient. Through close fit between the first telescopic connecting portion and the second telescopic connecting portion, structure stability of the matched two connecting portions is ensured in a telescopic state. When the hanging curtain is used, a force applied to the curtain fabric is vertical to, rather than parallel to, the hanging rod, therefore, in the actual use process, the telescopic connecting portions of the telescopic mechanism are free of deviation, and are kept stable. Meanwhile, in some situations, owing to the limitation effect of a mounting rack outside, deviation of the telescopic connecting portions of the telescopic mechanism is further prevented.

As a further improved embodiment, the first telescopic connecting portion 2 and the second telescopic connecting portion 3 have the same outer diameter. On the condition of ensuring the telescopic mechanism to be telescopic, the outer diameter of the whole rod (comprising the hanging rod body and the telescopic mechanism) is always kept consistent, which contributes to ensuring consistent outer diameter of the hanging rod and facilitating flat and steady winding and unwinding of a curtain fabric when the telescopic hanging rod for a curtain fabric of the present invention is used as the hanging rod of a roller blind.

As a further improved embodiment, referring to FIG. 2*a*, one end of the second telescopic connecting portion 3 away from the hanging rod body 1 is provided with a connecting part 5 for connection with other installation parts. The connecting part 5 can be connected with for example a curtain mounting frame.

As a further improved embodiment, referring to FIG. 2*b*, the telescopic hanging rod for a curtain fabric also comprises a locking mechanism 4 for locking the telescopic mechanism in a telescopic state. The locking mechanism 4 as well as the first telescopic connecting portion 2 and the second telescopic connecting portion 3 are coaxially disposed. The locking mechanism 4 penetrates into both the first telescopic connecting portion 2 and the second telescopic connecting portion 3, and can not only rotate around an axis but also move linearly in the axial direction. The locking mechanism 4 locks the adjusted first telescopic connecting portion 2 and second telescopic connecting portion 3 in a slidable connection state, i.e., the length of the hanging rod is locked, realizing adjustment on the length of the hanging rod. In addition, the locking mechanism 4 also has an unlocking function, thus assembly and disassembly are convenient.

As a further improved embodiment, referring to FIG. 7, the locking mechanism 4 comprises a columnar body 43. The external surface of the columnar body 43 is provided with locking slots 41. The internal surface of the first telescopic connecting portion 2 is provided with first locking blocks 21 matched with the locking slots 41. The internal surface of the second telescopic connecting portion 3 is provided with second locking blocks 31 matched with the locking slots 41. In the locking process, the columnar locking mechanism 4 rotates to insert the first locking blocks 21 and the second locking blocks 31 into the locking slots 41, and locking is achieved by virtue of fixation of the locking slots 41 to the locking blocks. When unlocking is needed, the columnar locking mechanism 4 is rotated reversely, so the locking blocks are rotated out of the locking slots 41 to achieve unlocking.

As a further improved embodiment, referring to FIG. 7, a plurality of locking slots 41 are provided. A locking slot row 41' extending axially is formed. At least one locking slot row 41' is arranged. When the first telescopic connecting portion 2 and the second telescopic connecting portion 3 extend away from each other, in the locking process, the locking slot 41 close to the hanging rod body 1 is used for insertion of the first locking block 21, and the locking slot 41 away from the hanging rod body 1 is used for insertion of the second locking block 31. Owing to the locking slot row 41', the telescopic mechanism can be locked after its length is changed in the axial direction.

As a more preferred embodiment, referring to FIG. 7, at least two locking slot rows 41' are arranged. The at least two locking slot rows 41' are evenly distributed along the circumferential direction of the columnar body 43 of the locking mechanism 4. By virtue of even distribution of the plurality of the locking slot rows 41', stability of the telescopic mechanism after locked is ensured, and locking of the first telescopic connecting portion 2 and the second telescopic connecting portion 3 is prevented from being damaged by outer factors such as vibration.

As a further improved embodiment, referring to FIG. 7, to conveniently insert the locking blocks into the locking slots in the rotating process, the side of the locking slot 41 first approaching to the locking block in the locking process is an open side, meanwhile to prevent the locking block from sliding out of the locking slot 41 due to excessive rotation, the side of the locking slot 41 secondarily approaching to the locking block in the locking process is a closed side so as to form a stop for the locking block, thus ensuring the locking block to be located into the locking slot after entering into it. The locking slot is of an "n"-similar shape.

As a further improved embodiment, referring to FIGS. 5-6, the first locking block 21 is arranged on the internal surface of the first telescopic connecting portion 2 away from the hanging rod body 1. The second locking block 31 is arranged on the internal surface of the second telescopic connecting portion 3 away from the hanging rod body 1. The locking blocks are disposed at these locations such that the length of the columnar body 43 of the telescopic mechanism is used to the utmost extent, the first telescopic connecting portion 2 and the second telescopic connecting portion 3 after telescopic are conveniently locked and fixed, and relative structure stability is ensured.

As a further improved embodiment, referring to FIG. 7, to prevent the locking mechanism 4 from sliding into both the first telescopic connecting portion 2 and the second telescopic connecting portion 3 in the use process, one end of the locking mechanism 4 away from the hanging rod body 1 is connected with an end cover 42. The end cover 42 rotates to drive the locking mechanism 4 to rotate. Due to the end cover 42, this end with the end cover 42 can be kept outside both the first telescopic connecting portion 2 and the second telescopic connecting portion 3. The lateral surface of the end cover 42 is a coarse surface, so that the friction force in holding is enhanced, and the end cover 42 is convenient to rotate in the mounting process.

As a further improved embodiment, referring to FIGS. 1, 2*b*, 4 and 7, a connecting part 5 arranged on the end surface of the end cover 42 away from the hanging rod body is also included. One end of the connecting part 5 penetrates through the end cover 42 into the locking mechanism 4 to be fixed. The connecting part 5 is used for connecting the hanging rod with other installation parts so as to conveniently mount the hanging rod to the to-be-installed location.

As a further improved embodiment, referring to FIGS. 5-6, the external surface of the first telescopic connecting portion 2 is provided with at least two sliding parts along the circumferential direction. The sliding parts are strip-like sliding parts of which lengths extend in the axial direction. The external surface of the second telescopic connecting portion 3 is provided with sliding grooves matched with the sliding parts. The sliding parts slide in the sliding grooves so as to make slidable connection of the first telescopic connecting portion 2 and the second telescopic connecting portion 3 come true, thus extending or contracting the telescopic mechanism of the hanging rod. When the sliding parts and the sliding grooves are matched, the external surface along the circumferential direction is substantially kept flat, i.e., the whole outer diameter of the hanging rod is always kept unchanged in its extending or contracting process.

As a further improved embodiment, referring to FIG. 5, the sliding parts comprises first sliding parts 22 and second sliding parts 23. The first sliding parts 22 and the second sliding parts 23 are distributed at intervals. The second sliding parts 23 are connected to the external lateral surface of the first telescopic connecting portion 2. One ends of the first sliding parts 22 close to the hanging rod body 1 are connected with the first telescopic connecting portion 2, and is suspended from the external lateral surface of the first telescopic connecting portion 2 (i.e., the bottom surfaces of the first sliding parts 22 do not contact with the surface of the first telescopic connecting portion 2).

To achieve match between the first sliding parts 22 and the second sliding parts 23, referring to FIG. 6, the sliding grooves comprise first sliding grooves 32 and second sliding grooves 33. The first sliding grooves 32 and the second sliding grooves 33 are distributed at intervals. The cross section of the first sliding groove 32 is C-shaped. Between two adjacent first sliding grooves 32, there is a gap so as to form the second sliding groove 33. The first sliding grooves 32 are matched with the first sliding parts 22. The second sliding grooves 33 are matched with the second sliding parts 23. Preferably, two sides of the C-shaped cross section of the first sliding groove 32 are curled sides, different from a concave shape with two straight sides. The distance between the tail ends of the two curled sides is slightly greater than the width of the widest portion of the first sliding part 21, i.e., the tail ends of the curled sides form clearance fit with the widest portion of the first sliding part 22, the limitation guiding effect of the first sliding groove 32 to the first sliding part 22 is ensured, and smoothness in sliding is also ensured. The first sliding part 22 is constructed as its bottom surface is separated from the external lateral surface of the first telescopic connecting portion 2 so match between the sliding part and the sliding groove becomes more stable, the second sliding groove 33 contacts with two lateral walls of the second sliding part 23 via its two lateral walls, and the bottom surface of the first sliding groove 32 contacts with the bottom surface of the first sliding part 22, thus friction force is reduced, smoothness in sliding is enhanced, and a large friction force caused by sliding of a common sliding groove through whole lateral surface contact or joint contact of a lateral surface and a bottom surface is avoided.

As a further improved embodiment, the section of the sliding part is of an isosceles trapezoid shape. The short side of the isosceles trapezoid is close to the external lateral surface of the first telescopic connecting portion 2, and its long side is away from the external lateral surface of the first telescopic connecting portion 2. Due to the section of an isosceles trapezoid, the sliding parts can be conveniently distributed on the external surface of the first telescopic connecting portion 2 along the circumferential direction.

As a further improved embodiment, referring to FIGS. 3 and 8, a curtain fabric mounting groove 34 extending along the axial direction is also formed on the external lateral surface of the hanging rod. One end of the curtain fabric is inserted or fixed in the curtain fabric mounting groove 34 via installation parts (e.g., a plugboard, a hook or the like).

The working process of the hanging rod of the present invention is described below in conjunction with FIGS. 1, 3, 4 and 9.

Figure 1:
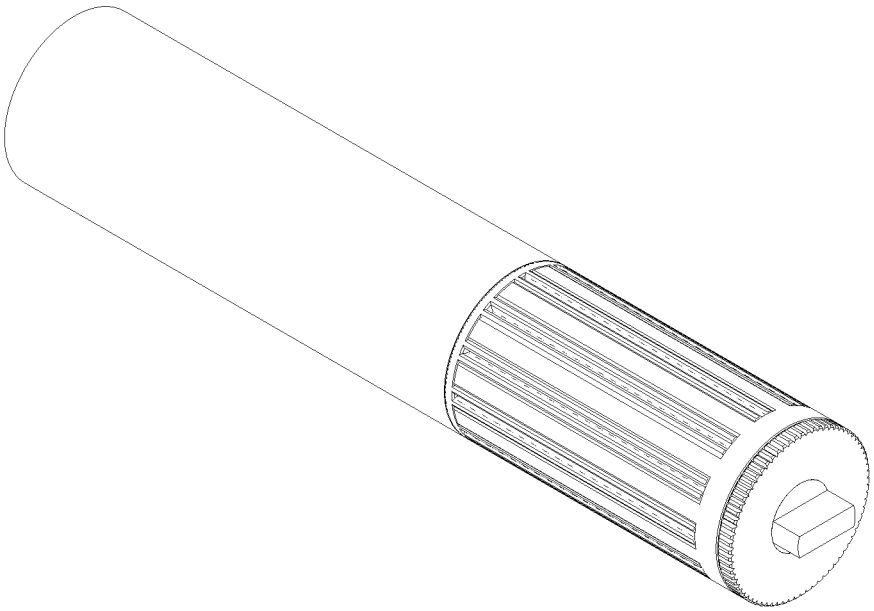
FIG. 1 is a schematic diagram of a telescopic hanging rod for a curtain fabric of the present invention in a contracted state.

FIG. 1 shows the telescopic mechanism in a completely contracted state. Referring to FIGS. 3 and 4, provided is the telescopic mechanism in a completely contracted state and a schematic diagram of an interior structure in locking, at this moment, the locking blocks (comprising the first locking blocks 21 and the second locking blocks 31) are all inserted into the locking slots 41, so the first telescopic connecting portion 2 and the second telescopic connecting portion 3 are fixed without relative sliding. If the length of the hanging rod needs to be adjusted, the locking mechanism 4 is rotated in the direction contrary to the locking direction so that the locking blocks are rotated out of the locking slots 41, i.e., unlocking of the locking mechanism 4 is completed, by this time, the first telescopic connecting portion 2 and the second telescopic connecting portion 3 can relatively slide. After the hanging rod extends to the desired length, the locking mechanism 4 is rotated in the locking direction so the locking blocks are inserted into the locking slots 41, i.e., locking of the hanging rod at the extended length is achieved (please refer to a schematic diagram of the telescopic hanging rod for a curtain fabric in an extended state in FIG. 9). In case of dissembling or shortening the hanging rod, the above process is followed, to be specific, unlocking of the locking mechanism 4 is carried out, then the first telescopic connecting portion 2 and the second telescopic connecting portion 3 slide to reduce the length, and finally locking of the locking mechanism 4 is performed (please refer to a schematic diagram of the telescopic hanging rod for a curtain fabric in a contracted state in FIG. 1). After the length of the telescopic mechanism of the hanging rod is adjusted, there is a need to mount other installation parts which play a clamping role for the telescopic mechanism and are connected with the connecting part 5 on the end portion, therefore, structure and state stability of the telescopic mechanism can be further ensured. The telescopic hanging rod for a curtain fabric of the present invention is applicable to a window curtain, a door curtain, a shower curtain or other curtain fabrics, and may be produced in a perforation type or perforation-free type.

Any materials, reagents and experimental equipment involved in the embodiments of the present invention belong to commercially available products of the curtain fabric devices unless particularly stated.

The described above is merely the preferred embodiments of the present invention. It should be pointed out that, for persons having ordinary skill in the art, any improvements and modifications made without departing from the core technology of the present invention are appreciated. These improvements and modifications shall fall into the scope of the present invention. The scope of the present invention is intended to embrace any changes as fall within the scope of the claims, together with all equivalents thereof.

We claim:

1. A telescopic hanging rod for a curtain fabric, wherein the telescopic hanging rod comprises a hanging rod body and a telescopic mechanism arranged on at least one end of the hanging rod body; the telescopic mechanism comprises a first telescopic connecting portion connected to the hanging rod body, and a second telescopic connecting portion slidably connected with the first telescopic connecting portion; the first telescopic connecting portion and the second telescopic connecting portion are coaxially arranged;

wherein the first telescopic connecting portion and the second telescopic connecting portion have the same outer diameter;

wherein the telescopic hanging rod further comprises a locking mechanism for locking the telescopic mechanism in a telescopic state; the locking mechanism, the first telescopic connecting portion and the second telescopic connecting portion are coaxially arranged; the locking mechanism penetrates into both the first telescopic connecting portion and the second telescopic connecting portion, and is rotatable around an axis and linearly movable in the axial direction.

2. The telescopic hanging rod for a curtain fabric of claim 1, wherein one end of the second telescopic connecting portion, the end of which away from the hanging rod body, is provided with a connecting part.

3. The telescopic hanging rod for a curtain fabric of claim 1, wherein the locking mechanism comprises a columnar body; the external surface of the columnar body is provided with a locking slot; the internal surface of the first telescopic connecting portion is provided with a first locking block matched with the locking slot, and the internal surface of the second telescopic connecting portion is provided with a second locking block matched with the locking slot.

4. The telescopic hanging rod for a curtain fabric of claim 3, wherein a plurality of locking slots are provided and they form a locking slot row extending axially, and at least one locking slot row is arranged.

5. The telescopic hanging rod for a curtain fabric of claim 4, wherein at least two locking slot rows are arranged, and these at least two locking slot rows are evenly distributed along the circumferential direction of the columnar body of the locking mechanism.

6. The telescopic hanging rod for a curtain fabric of claim 3, wherein in accordance with the rotating direction of the columnar body during the locking process, the side of the locking slot first approaching to the locking block is an open side, and the side of the locking slot secondarily approaching to the locking block is a closed side.

7. The telescopic hanging rod for a curtain fabric of claim 3, wherein the first locking block is arranged on the internal surface of the first telescopic connecting portion away from the hanging rod body, and the second locking block is arranged on the internal surface of the second telescopic connecting portion away from the hanging rod body.

8. The telescopic hanging rod for a curtain fabric of claim 1, wherein one end of the locking mechanism, the end of which away from the hanging rod body, is connected with an end cover, and the end cover rotates to drive the locking mechanism to rotate.

9. The telescopic hanging rod for a curtain fabric of claim 8, wherein the lateral surface of the end cover is a coarse face.

10. The telescopic hanging rod for a curtain fabric of claim 8, wherein a connecting part is arranged on the end face of the end cover away from the hanging rod body.

11. The telescopic hanging rod for a curtain fabric of claim 10, wherein one end of the connecting part penetrates through the end cover and inserts into the locking mechanism to be fixed.

12. The telescopic hanging rod for a curtain fabric of claim 1, wherein the external surface of the first telescopic connecting portion is provided with at least two sliding parts along the circumferential direction; the sliding parts are strip shaped sliding parts of which the lengths extend in the axial direction; the external surface of the second telescopic connecting portion is provided with sliding grooves matched with the sliding parts.

13. The telescopic hanging rod for a curtain fabric of claim 12, wherein the sliding part comprises a first sliding part and a second sliding part; the first sliding part and the second sliding part are distributed at intervals; the second sliding part is directly connected with the external lateral surface of the first telescopic connecting portion; one end, close to the hanging rod body, of the first sliding part is connected with the first telescopic connecting portion, and is suspended from the external lateral surface of the first telescopic connecting portion.

14. The telescopic hanging rod for a curtain fabric of claim 13, wherein the sliding groove comprise a first sliding groove and a second sliding groove; the first sliding groove and the second sliding groove are distributed at intervals; the cross section of the first sliding groove is a "C" shape; a gap between every two adjacent first sliding grooves form the second sliding groove; the first sliding groove is matched with the first sliding part and the second sliding groove is matched with the second sliding part.

15. The telescopic hanging rod for a curtain fabric of claim 14, wherein the two sides of the "C" shape cross section of the first sliding groove are with curled edges, and the distance between the tail ends of the two curled edges is slightly greater than the width of the widest portion of the first sliding part.

16. The telescopic hanging rod for a curtain fabric of claim 12, wherein a section of the sliding part is of an isosceles trapezoid shape; the short side of the isosceles trapezoid is close to the external lateral surface of the first telescopic connecting portion, and the long side is far away from the external lateral surface of the first telescopic connecting portion.

17. The telescopic hanging rod for a curtain fabric of claim 1, wherein the external lateral surface of the telescopic hanging rod for a curtain fabric is further provided with a mounting groove for the curtain fabric extending in the axial direction.

* * * * *